United States Patent [19]

Shepard

[11] 4,281,779

[45] Aug. 4, 1981

[54] DISPENSING VALVE

[76] Inventor: John S. Shepard, 1304 S. Shields St., Ft. Collins, Colo. 80521

[21] Appl. No.: 4,359

[22] Filed: Jan. 18, 1979

Related U.S. Application Data

[63] Continuation-in-part of Ser. No. 939,126, Sep. 5, 1978, abandoned.

[51] Int. Cl.[3] ..... B65D 25/38

[52] U.S. Cl. ..... 222/501; 222/518; 401/214; 401/216

[58] Field of Search ..... 222/501, 205, 207, 518, 222/584; 401/209, 212, 214, 215, 216, 260, 259; 251/321, 322, 323

[56] References Cited

U.S. PATENT DOCUMENTS

| | | | |
|---|---|---|---|
| 1,194,347 | 8/1916 | Allen | 401/214 |
| 1,670,458 | 5/1928 | LeBoeuf | 401/214 |
| 1,839,160 | 12/1931 | Nissen | 401/214 |
| 2,113,695 | 4/1938 | Krannak | 401/214 |
| 2,122,580 | 7/1938 | Morris | 401/214 |
| 2,206,053 | 7/1940 | Schroeder | 222/501 X |
| 2,554,660 | 1/1971 | Woods | 401/214 |
| 2,930,062 | 3/1960 | Reimann | 222/501 X |
| 2,968,826 | 1/1961 | Leshin | 401/214 |
| 3,088,161 | 5/1963 | Schaich | 401/216 X |
| 3,216,399 | 11/1965 | Sams | 401/216 |
| 3,241,727 | 3/1966 | Heckman | 222/518 X |
| 3,456,650 | 7/1969 | Schwartzman | 222/205 X |

FOREIGN PATENT DOCUMENTS

| | | | |
|---|---|---|---|
| 2304529 | 8/1974 | Fed. Rep. of Germany | 401/216 |
| 975191 | 10/1950 | France | 401/216 |
| 260917 | 11/1926 | United Kingdom | 222/501 |

*Primary Examiner*—F. J. Bartuska
*Attorney, Agent, or Firm*—Hugh H. Drake

[57] ABSTRACT

A valve mechanism for dispensing viscous, sticky materials from a container having a neck defining a discharge opening. The valve is formed by a tubular body threaded at one end for engaging the container neck. A normally closed spring biased valve in said body controls the discharge of material from said container. The valve body defines a spheroidal dispensing cavity opening through one end thereof for accessibly retaining for subsequent use an increment of material discharge from the container through the valve. In an alternative version, a ball valve is so seated as to preclude wedging of the material into the valve seat.

5 Claims, 11 Drawing Figures

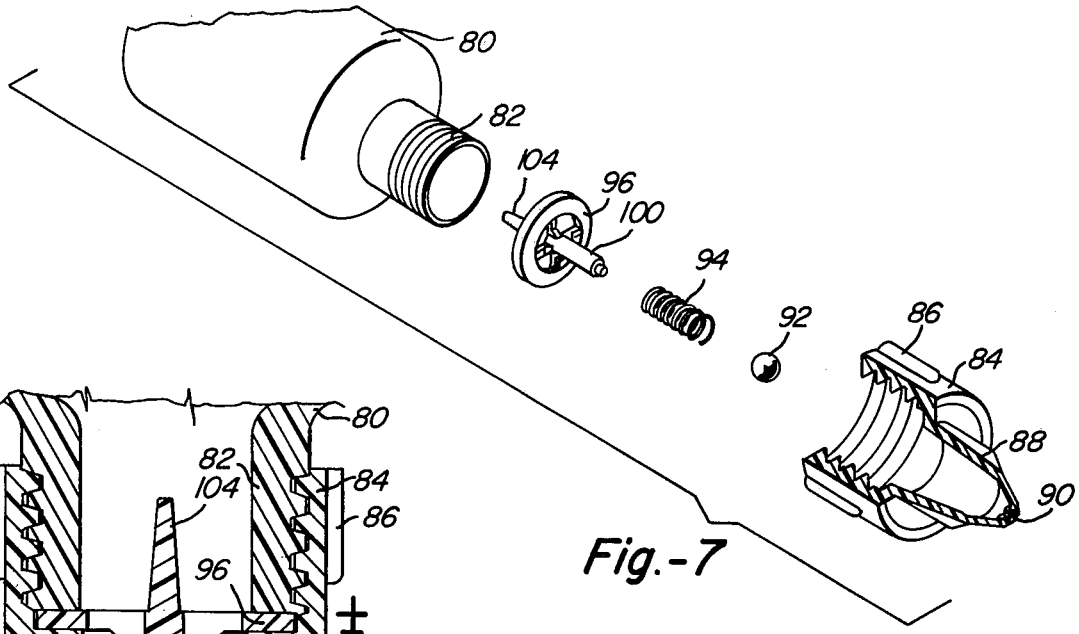
Fig.-7
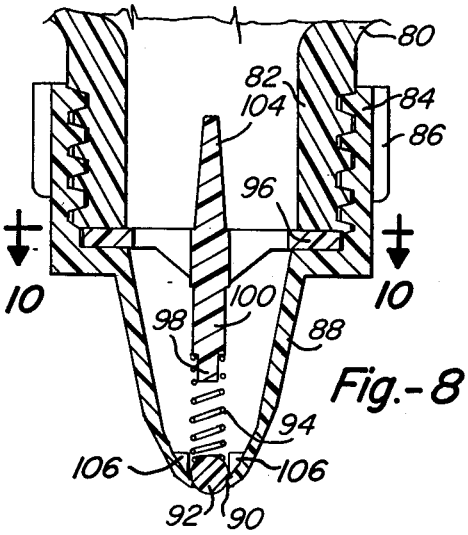
Fig.-8
Fig.-9
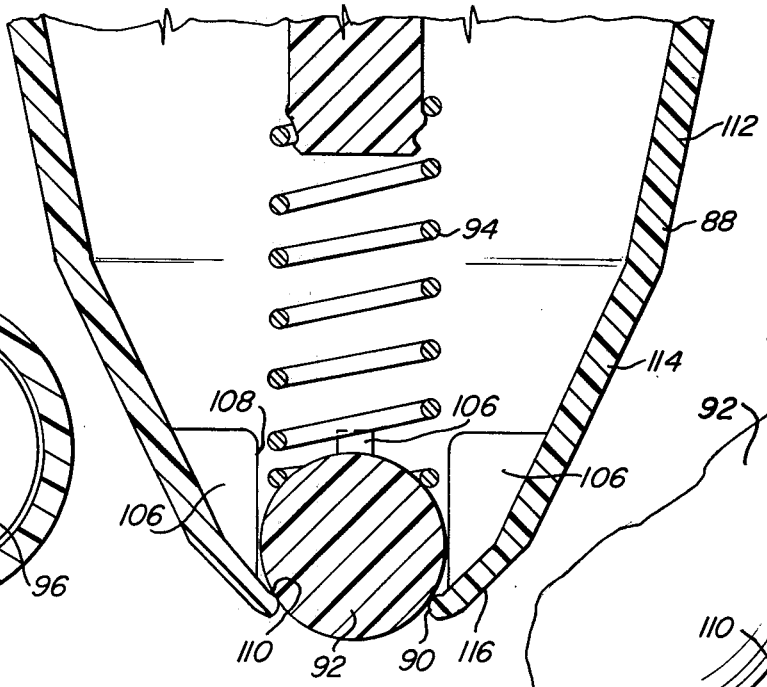
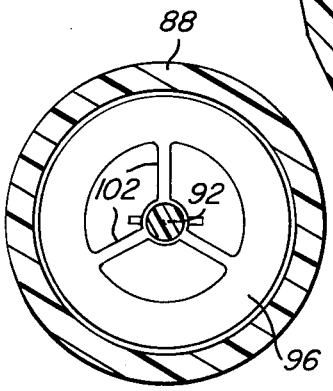
Fig.-10
Fig.-11
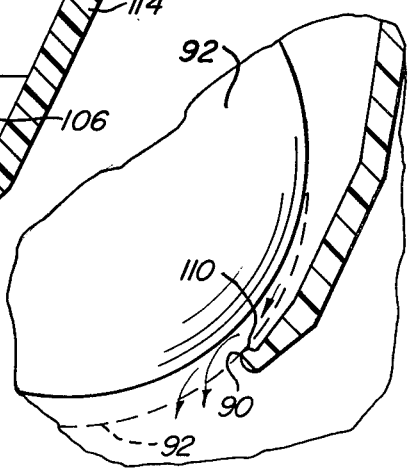

DISPENSING VALVE

RELATED APPLICATION

This is a continuation-in-part of concurrently pending application Ser. No. 939,126, filed Sept. 5, 1978, now abandoned.

FIELD OF THE INVENTION

The present invention relates to a dispensing valve preferably with a material retaining reservoir, and more particularly to non-gumming, self-closing valves finding particular, but not necessarily exclusive, utility for dispensing viscous sticky materials such as dental varnish, glue and the like.

OBJECTS AND SUMMARY OF THE INVENTION

It is the principal object of the present invention to provide an improved non-gumming, non-sticking self-closing valve for dispensing and retaining a working quantity of a viscous, sticky material.

Another object of the present invention is to provide a valve of the foregoing character which includes an access reservoir which is easily utilized with a cotton dab without catching cotton fibers in the valve.

A further object of the present invention is to provide a valve which affords a sufficient passage to allow the flow of viscous sticky materials and which is self-closing with a minimum probability of the valve becoming gummed, plugged or sealed closed.

Still another object of the present invention is to provide a self-closing valve with a combined reservoir for retaining a working quantity of the material to be dispensed, which reservoir is easily accessible for dispensing the material and is readily cleaned.

At the same time, ti is also an objective of the present invention to provide a new and improved self-closing valve for handling such materials but yet which is capable of being economically mass produced for use with ordinary glue containers intended even for household use or the like.

Other objects and advantages will become apparent as the following description proceeds taken in connection with the accompanying drawings.

In accordance with the foregoing objects, the invention is embodied in a dispensing valve for use on a container having contents to be dispensed in small increments. The valve comprises a valve body having an internally threaded bore in one end thereof for engagement with an externally threaded neck on said container and a central counterbore extending from said threaded bore to an inwardly and forwardly sloping annular shoulder. The counterbore defines a rearwardly directed shoulder with said threaded bore. A spheroidal reservoir cavity is defined in the other end of the body with the cavity opening into the end of said body and defining an annular concave chamber. A valve passage opens between the annular shoulder in said counterbore and said spheroidal cavity. The wall of the passage cooperates with the sloping shoulder to define a valve seat. A valve stem is slidably positioned in the body and is provided with an annular valve member or valve disc defining a forwardly sloping valve surface for sealing engagement with the seat. A spider is supported in the valve body between the rearwardly directed shoulder and an inserted container neck and includes a central guide sleeve for guidably receiving an inserted end of the valve stem. For biasing the valve to the closed portion, a valve spring surrounds the sleeve and acts between the spider and the valve member. The valve stem extends forwardly of the valve member within the passage and is provided with a recess in its exposed end for engagement by a tool to open the valve against the biasing force of said valve spring to allow increments of the material to be dispensed into the reservoir cavity for subsequent use.

In alternative versions that use a ball valve, the diameter of the valve is selected relative to the diameter of a matching seat such that better sealing is obtainable by the avoidance of wedging of the material upon seating of the valve.

Other features employed in particular with respect to an alternative version pertain to constraints upon the ball valve by reason of especial formation of the valve body, so as to achieve proper delivery of sticky materials on demand while yet enabling production at reduced cost.

DESCRIPTION OF THE DRAWINGS

FIG. 7 is an exploded perspective view, partially in section, of a further alternative embodiment;

FIG. 8 is an enlarged longitudinal cross-sectional view of a portion of the embodiment of FIG. 7 as assembled;

FIG. 9 is a fragmentary cross-sectional view in further enlargement of that which is shown in FIG. 8;

FIG. 10 is a cross-sectional view taken along the line 10—10 in FIG. 8; and FIG. 11 is a fragmentary still-additional enlargement of a portion of that which is shown in FIG. 9.

DESCRIPTION OF THE PREFERRED EMBODIMENTS

Figure 1:
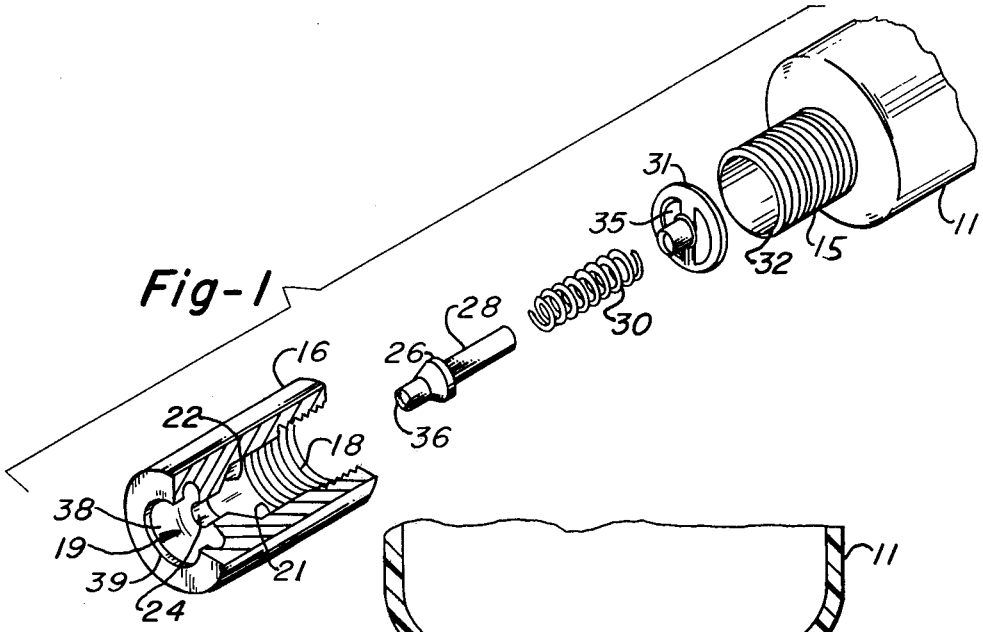
FIG. 1 is an exploded perspective view, partly in section, of a valve mechanism and associated reservoir embodying the present invention.
Figure 2:
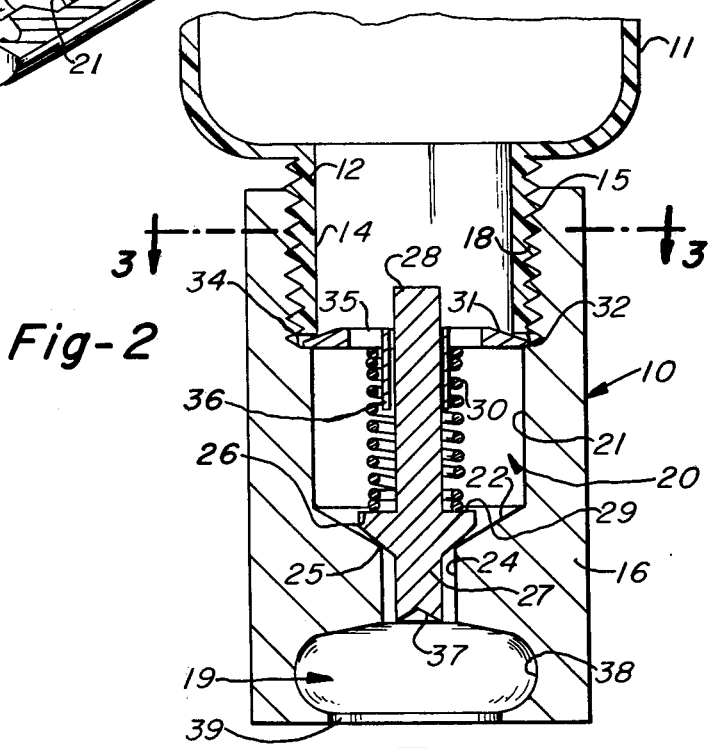
FIG. 2 is an enlarged vertical section view of a valve and reservoir embodying the present invention.
Figure 3:
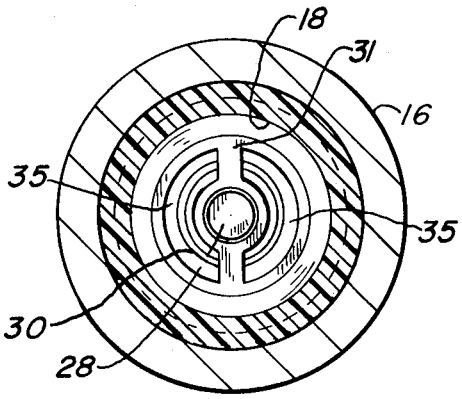
FIG. 3 is a section view taken substantially in the plane of line 3—3 on FIG. 2.
Figure 4:
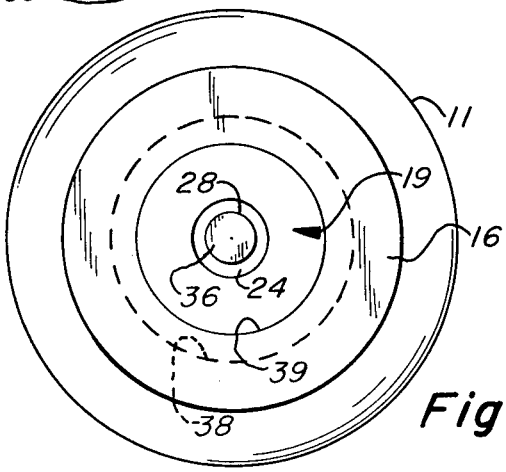
FIG. 4 is a front end view of the valve and reservoir shown in FIG. 2.

A valve and reservoir mechanism is shown in the drawings at 10 in association with a container, such as a plastic bottle 11, containing the material to be dispensed. The valve and reservoir mechanism finds particular but not necessarily exclusive utility for dispensing viscous, sticky materials such as dental varnish, for example, "Copalite", or glues, paints and the like. "Copalite" is an intermediary varnish and detinal tubuli seal. The container 11 may be of any suitable material, such as flexible or rigid plastic, and is provided with a neck 12 defining a discharge opening 14 and provided with external threads 15 for threadably receiving a cap or closure (not shown). In use, the cap or closure is discarded and a dispensing valve such as a dispensing and reservoir valve 10 embodying the present invention is threadably secured on the container neck.

In dispensing viscous, sticky material such as dental varnish, it is desirable to contain the material in a cup or reservoir so that the user can dab a swab or wad of material such as cotton into the varnish for subsequent application to the desired surface. Accordingly, it is desirable to be able to discharge an amount of the material from the container into the reservoir only in small quantities as needed. It is further desirable that the dispensing valve be such as to prevent the same from gumming or freezing as a result of the hardening of the material being dispensed. To this end, the valve and reservoir mechanism 10 embodying the present invention comprises a generally cylindrical housing or body 16 defining at one end an internally threaded bore 18 for threaded engagement with the neck threads 15 on the container 11. At its other end, the body 16 desirably includes a reservoir 19 for retaining material dispensed through a dispensing valve 20 positioned interiorly of the body 16 and effectively and normally closing the open end of the container 11.

For supporting the valve 20, the body 16 defines a counterbore 21 extended from the threaded bore 18 to a forwardly tapered shoulder 22 extending to an outlet passage 24 opening into a reservoir 19. The ridge or shoulder between the tapered shoulder 22 and outlet passage 24 defines a valve seat or rim 25 which is sealingly engaged by a tapered annular valve surface 26 on a frusto-conical valve disc or rib 27 integrally formed intermediate the ends of a valve stem 28.

For holding the valve in a releasably normally closed position, the valve stem is surrounded by a coil closing spring 30 acting between a shoulder 29 on the rear face of the valve flange 26 and a spider or washer 31 clamped between the neck rim 32 of the container neck and a shoulder 34 defined between the threaded bore 18 and counterbore 21. The spider 31 is provided with a plurality of passages 35 through which material flows from the container to the outlet passage 24, and is formed with a central tube or neck 36 for guidably receiving an inserted inner end of the valve stem 28.

At its outer end, the valve stem 28 is provided with a recess 37 which may be engaged by the tip of a tool or probe to push the valve stem back against the force of the spring 30 to open the valve and allow material to flow from the container through the valve opening between the seat 25 and disc 27 into the reservoir 19.

The reservoir 19 is generally spheroidal in shape and positioned to provide an annular concave wall 38 with a large central circular opening 39 in the front wall of the valve housing 16 opposite from the opening of the valve passage 24. Material discharged from the container through the valve 20 is retained in the reservoir 19. A brush or other tool, cotton swab or a wad of cotton held on a pair of tweezers may be inserted through the front opening 39 and dabbed into the material retained in the reservoir 19. When the material in the reservoir 19 has been used up, the valve can be opened by pushing on the valve stem 28 with a probe or pair of tweezers to allow more material to discharge into the reservoir through the valve opening and passage 24. When the desired amount of material has been utilized from the reservoir, the reservoir can be readily cleaned by wiping it out and by cleaning it with a solvent if necessary.

The valve is constructed to provide for the free flow of viscous sticky material. To this end, the counterbore 21 is relatively large and is approximately the size of the container neck opening. The sloping shoulder 22 is sufficiently steep to provide for the desired flow while the outlet passage 24 provides a free flow passage relative to the portion of the central valve stem 28 forward of the disc 27. The annular valve member or disc 27 on the valve stem 28 is provided with a relatively steep sloping surface 26 which provides an effective seal when the surface 26 is held against the valve seat 25 by the valve spring 30. It should be noted that the valve is located away from the reservoir and is protected by the passage 24 so that cotton fibers and the like will not lodge in the valve itself to prevent sealing.

The dispenser seals well against evaporation of the base or carrier in the material. It permits the avoidance of the mess heretofore associated with the application of such a material. At the same time, there is less waste of the material which, in the case of a dental varnish, is very expensive. In the avoidance of gumming of the valve assembly, there is no air contact to the material within the main container or that within counterbore 21.

Reservoir 19 may vary in size, depending upon the particular material being dispensed. Its diameter and depth are selected in view of the viscosity of the material, so as to avoid spillage from the cup in normal usage. Similarly, the sizes of openings 35 and the space between the wall of passage 24 and the adjacent portion of stem 28 are selected to permit adequate flow of the material while yet avoiding a copious outflow.

Figure 5:
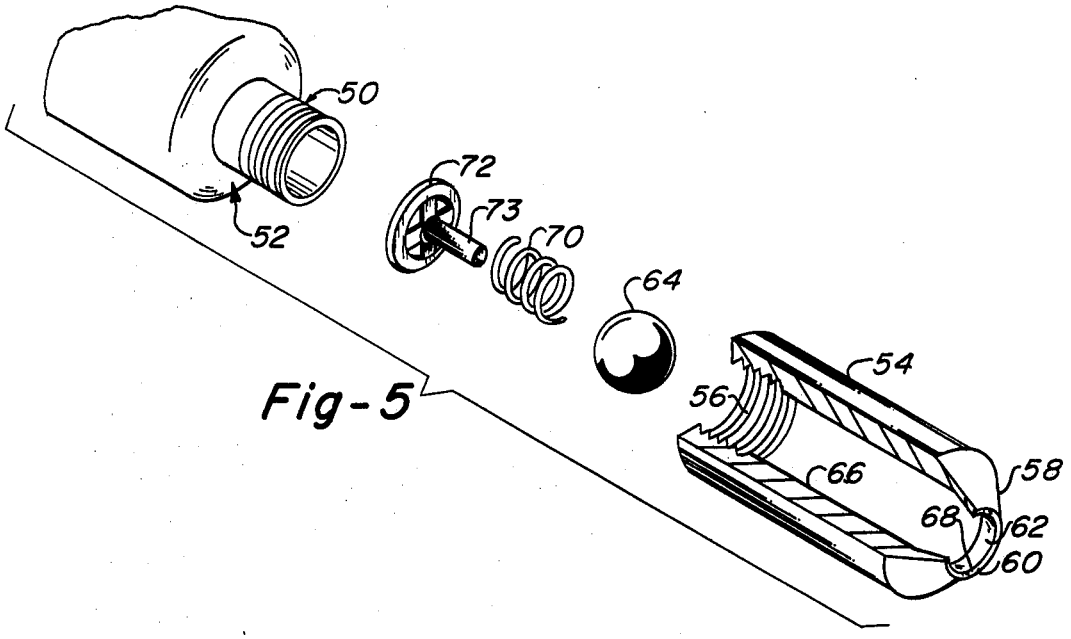
FIG. 5 is an exploded perspective view of an alternative embodiment of a valve assembly.
Figure 6:
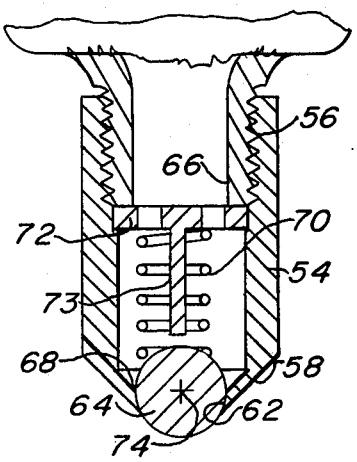
FIG. 6 is a longitudinal cross-sectional view of the valve arrangement of FIG. 5.

In the alternative more economical but less preferred dispenser of FIGS. 5 and 6, a simple ball valve assembly is so conformed as to be able to handle the viscous, sticky materials of the type mentioned above. For mounting on the externally-threaded neck 50 of a supply container 52 is a dispenser valve body 54 internally threaded at one end 56 for engaging neck 50. The other end of body 54 is conformed to define an annular cone segment 58 that projects from its base longitudinally outward from body 54. Cone segment 58 terminates in a cylindrical opening 60 that has a laterally inner marginal wall 62 of semi-hemispherical contour.

A spherical ball valve 64 is located within the cylindrical hollow bore 66 of body 54, so as to be sealingly engageable with wall 62. To that end, ball valve 64 has a radius which is the same as the radius of the contour of wall 62. Moreover, ball valve 64 has a diameter which is the same as the diameter of the longitudinally inward rim 68 of wall 62. That is, the geometrical center 74 of ball valve 64 is laterally aligned with rim 68.

A spring 70 is compressed between ball valve 64 and a spider 72. Spring 70 is captivated around a pin 73 which projects integrally from spider 72 toward ball 64. Thus, spring 70 urges ball valve 64 against the seat defined by wall 62. Of course, spider 72 defines a plurality of flow passages analogous to passages 35 in spider 31 of the earlier embodiment.

The arrangement of FIGS. 5 and 6 is capable of handling the type of material under discussion because it tends to preclude the accumulation of the material on the outward half of the ball valve. This is by reason of the specified diametral and radial relationships that tend to preclude the formation of a wedge of material between the outwardly facing side of the ball and its seat. By instructing the user to swab the seating area each time after use, a tight seal may be maintained between uses.

Preferably, bore 66 is of a diameter at least twice the diameter of ball valve 64. That presents a large surface area against the ball valve, so as to make it easier to extrude the material. Cone segment 58 is assigned a taper of forty-five degrees. That angle has been found to be rather critical in this particular embodiment to insuring proper dispensing without clogging. With ball 64 having a diameter of three-sixteenths inch, pin 73 is formed to have a length such that its free end defines a stop which is spaced by one-sixteenth inch from ball 64 when the latter is seated against wall 62.

As specifically illustrated, all parts of the dispenser of FIGS. 5 and 6 are metallic. In a preferred version, however, all parts except spring 70 are formed of plastic. In that case, ball 64 is of a relatively hard material such as Teflon. In contrast, valve body 54 is of a softer material such as polyethylene. Still further, cone segment 58 is sufficiently thin as to exhibit lateral flexibility. The combination of these relative degrees of hardness with the flexibility of segment 58 has been found to afford increased freedom from sticking of ball 64 to wall 62 as well as to permit easier opening of the ball valve to any extent that there is a degree of sticking.

To preclude any tendency of spring 70 to cock toward one side, the inner wall of valve body 54 may include a plurality of inwardly-projecting longitudinal ribs, for example four in number, spaced successively around that inner wall and each of a width to define a cavity within which spring 70 is more closely confined than as illustrated. Of course, such ribs must leave a passage for free inward movement of ball 64 as far as the stop defined by pin 73. When desired, a needle-like nose may project away from the side of spider 72 opposite pin 73, so as to be received within a corresponding narrow aperture formed centrally through neck 50. That nose may even be stepped in diameter for the purpose of accommodating more than one size of aperture.

The embodiment shown in FIGS. 7–11 includes certain of the features just discussed as well as additional improvements. It is a simplified approach preferred over that of FIGS. 5 and 6.

In FIGS. 7–11, there is shown a container 80 having an externally threaded outlet neck 82 upon which is coupled a correspondingly internally-threaded cap 84. Cap 84 peripherally includes a circumferentially spaced series of laterally projecting nubs 86 which assist the user in screwing the cap on or off the neck. At the outer end of cap 84 is a cone segment 88 which terminates in a cylindrical opening 90.

A spherical ball valve 92 is located within the cylindrical hollow bore of cap 84, so as to be sealingly engageable with the inner marginal wall of opening 90. A spring 94 is compressed between ball valve 92 and a spider 96. One end of spring 94 is received upon a necked down stub 98 formed on the outer end of a pin 100 which projects integrally from spider 96 toward ball 92. Spider 96 supports pin 100 by means of a plurality of radial struts 102. Projecting integrally inward from spider 96 is a needle 104 which may serve in use to penetrate a fluid-flow opening in the top of neck 82 of container 80.

Disposed within the outer end portion of cone 88 are a plurality of circumferentially-spaced individually longitudinally-oriented ribs 106 that project inwardly and define a cavity 108 within which the outer end of compression spring 94 is confined and which also serves to laterally confine ball 92. Besides defining a path of movement for ball 92, ribs 106 serve to avoid undesirable cocking of the outer end of spring 94 to one side or the other.

The diameter of ball 92 corresponds at least closely to that of the longitudinally inward rim 90 at the marginal wall of cone segment 88. Moreover, the extremity of segment 88 is formed to include a reenforcing rib 110 which circumscribes the interior of opening 90 and has a conformation to restrain exit of ball 92 through opening 90 even though the walls of cone segment 88 are laterally flexible. That flexibility of at least the outer end portion of cone segment 88 has been found to assist in freeing ball 92 for movement when it otherwise becomes stuck by dried glue.

For best performance, it has been found that cone segment 88 should include a first portion 112 coupled to the body of cap 84 at a given angle as illustrated and then further including a second portion 114 that tapers toward the center more sharply. Cone segment 88 thereafter desirably is conformed so as to exhibit a still further tapering toward the center, as indicated at 116, in leading to a final termination at opening 90.

Of course, many of the various different features of the correspondingly different embodiments may be intermixed when desired. That is particularly true with regard to the possibility of interchanging features as between the embodiments of FIGS. 5 and 6 on the one hand, and the embodiment of FIGS. 7–11 on the other. Further, however, the internal valve formation or the reservoir of FIGS. 1–4 may be adapted to the approaches of the later embodiments.

While certain illustrative embodiments have been shown in the drawings and described in this specification, and other modifications have been pointed out, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A dispenser valve assembly for dispensing a viscous, sticky material from a container having a neck defining a discharge opening, said assembly comprising:

a dispenser valve body;

means on said body for engaging said neck;

normally closed valve means disposed within said body and exclusive of said container for preventing discharge of said material from said container;

a dispensing cavity located rigidly in said body, having an access opening through one end thereof to the exterior of said valve body and remote from said engaging means, for accessibly retaining for subsequent use an increment of material discharged from said container through said valve means;

means in said body defining an elongated passage for said material and coupled at one end to said valve means and opening at its other end into said cavity;

said access opening facing outwardly away from said one end of said passage means and said cavity being generally spheroidal in shape with a generally annular concave interior wall extending outwardly from said other end of said passage to said access opening;

and said valve means including a stem portion, disposed in said passage and exposed from within said cavity, for enabling valve opening by manipulation of a tool inserted through said access opening into engagement with a facing end of said stem portion.

2. A dispenser valve assembly as defined in claim 1 wherein said valve means includes a valve stem having a frusto-conical valve disc intermediate the ends thereof adapted to sealingly engage a circular valve seat in said body, a spider for guidably supporting one end of said stem, and a means acting between said spider and said valve disc for biasing said valve means to the closed position.

3. A valve and reservoir mechanism for dispensing a small amount of a viscous sticky material from a container having a neck defining a discharge opening and depositing and retaining said viscous sticky material as a film on a surface to be wiped with a swab, comprising a tubular dispenser body, means on one end of said body for sealingly engaging said neck, a spring biased normally closed discharge valve means disposed exclusively within said body for controllably closing said container to prevent the discharge of material therefrom, a reservoir cavity located rigidly in said body at the end thereof opposite from said neck engaging means and including an interior surface extending outwardly from said discharge valve at an angle sufficient to cause said viscous fluid to adhere to and flow on said interior surface as it emerges from said valve, an access opening at the outer end of said body with said access opening extending into said reservoir cavity from the exterior of said body and adapted for receiving a swab insertable therein from the exterior of said body into contact with said material retained on the walls of said cavity after opening of said valve means, and an elongated stem projecting away from said valve means to dispose a free end exposed from within said cavity for enabling valve opening by manipulation of a tool inserted through said opening into engagement with said end of said stem.

4. A dispensing valve for use on a container of material to be dispensed incrementally, said valve comprising a valve body having an internally threaded bore in one end thereof for engagement with an externally threaded neck on said container, a central counterbore in said body extending from said threaded bore to an inwardly and forwardly sloping annular shoulder, said counterbore defining a rearwardly directed shoulder with said threaded bore, a spheroidal reservoir cavity defined in the other end of said body, said cavity opening into the end of said body and defining a chamber with annular concave walls, a passage opening between said annular shoulder in said counterbore and said spheroidal cavity, the wall of said passage cooperating with said sloping shoulder to define a valve seat, a valve stem slidably positioned in said body, said stem having an annular valve disc member defining a forwardly sloping valve surface for sealing engagement with said seat, a spider supported on said valve body between said rearwardly directed shoulder and an inserted container neck, said spider including a central guide sleeve for guidably receiving an inserted end of said valve stem, and a valve spring surrounding said sleeve and acting between said spider and said valve disc member for biasing said valve to seat said valve disc member on said valve seat, and said valve stem extending forwardly of said valve member within said passage and including a recess in its exposed end for engagement by a tool to open said valve against the biasing force of said valve spring to allow increments of the material to be discharged from the container into said reservoir cavity for subsequent use therefrom.

5. A dispenser valve assembly for dispensing viscous, sticky materials from a container having a neck defining a discharge opening and comprising:

a dispenser valve body having a cylindrical hollow bore;

means on one end of said body for engaging said neck;

means on the other end of said body defining an annular cone segment of laterally flexible material and from its base longitudinally outward from said body and terminating in a cylindrical opening having a lateral innermarginal wall;

a spherical ball located within said bore for sealing engagement with said marginal wall, the diameter of said ball being substantially the same as that of the longitudinally inward rim of said marginal wall;

means within said bore for resiliently urging said ball against said marginal wall;

said cone segment interiorly first tapering inwardly from said other end of said body at a given angle and then having a portion tapering inwardly more sharply toward said marginal wall;

a plurality of webbed projections extending radially inwardly from the interior wall of said cone segment into guiding contact with said ball, including guide edges on said projections substantially parallel to the longitudinal axis of said cone segment adapted to allow said ball relatively uninhibited longitudinal movement but restraining said ball from lateral movement, and said projections being angularly spaced apart from each other a distance sufficient to allow said viscous fluid to flow therebetween and not be retained therein by clogging;

and means defining a structurally re-enforcing rib circumscribing the interior of said opening at the exit from said more sharply defined portion and conformed to restrain exit of said ball through said opening.

* * * * *